United States Patent [19]

Small et al.

[11] Patent Number: 4,573,513

[45] Date of Patent: Mar. 4, 1986

[54] MODULAR PANEL CONSTRUCTION

[75] Inventors: Marc J. Small, Perrysburg; David E. Powers, Toledo, both of Ohio

[73] Assignee: Good Displays, Inc., Toledo, Ohio

[21] Appl. No.: 490,784

[22] Filed: May 2, 1983

[51] Int. Cl.[4] ..... A47G 5/00

[52] U.S. Cl. ..... 160/135; 160/351; 211/194

[58] Field of Search ..... 160/135, 229 R, 351, 160/352; 52/580, 582, 578, 588; 211/194

[56] References Cited

U.S. PATENT DOCUMENTS

| | | | |
|---|---|---|---|
| 3,037,593 | 6/1962 | Webster | 160/135 |
| 3,247,891 | 4/1966 | Sadoff, Jr. | 160/229 R |
| 3,327,440 | 6/1967 | Watkins | 52/582 |
| 3,589,755 | 6/1971 | King | 52/582 |
| 3,817,396 | 6/1974 | Markson | 160/135 |
| 3,856,981 | 12/1974 | Boundy | 160/135 |
| 4,030,219 | 6/1977 | Donovan | 160/135 |
| 4,201,020 | 5/1980 | Saunders | 52/580 |
| 4,278,145 | 7/1981 | Eade et al. | 160/135 |
| 4,323,163 | 4/1982 | Johns | 52/588 X |
| 4,375,829 | 3/1983 | Dorr et al. | 160/135 |
| 4,416,093 | 11/1983 | Salkeld et al. | 160/135 |
| 4,420,087 | 12/1983 | Johns | 52/588 X |
| 4,436,135 | 3/1984 | Ytter | 160/135 |
| 4,443,911 | 4/1984 | Bannister | 160/135 |
| 4,517,232 | 5/1985 | Krauser | 52/588 X |

*Primary Examiner*—Ramon S. Britts
*Assistant Examiner*—David M. Purol
*Attorney, Agent, or Firm*—Marshall & Melhorn

[57] ABSTRACT

The present invention relates to a modular panel construction comprising a plurality of generally rectangular, individual panel sections. The panel sections include side coupling brackets for interconnecting the adjacent side marginal edges of adjacent panel sections. A tongue and groove arrangement is provided for coupling the lower marginal edge of an upper section with the upper marginal edge of an adjacent lower section. The plurality of sections cooperate to form a wall panel having an outer periphery defined by the arrangement of the panel sections. A pair of spaced apart hinge brackets are utilized to pivotally connect one wall panel to a second wall panel.

1 Claim, 9 Drawing Figures

FIG. 7
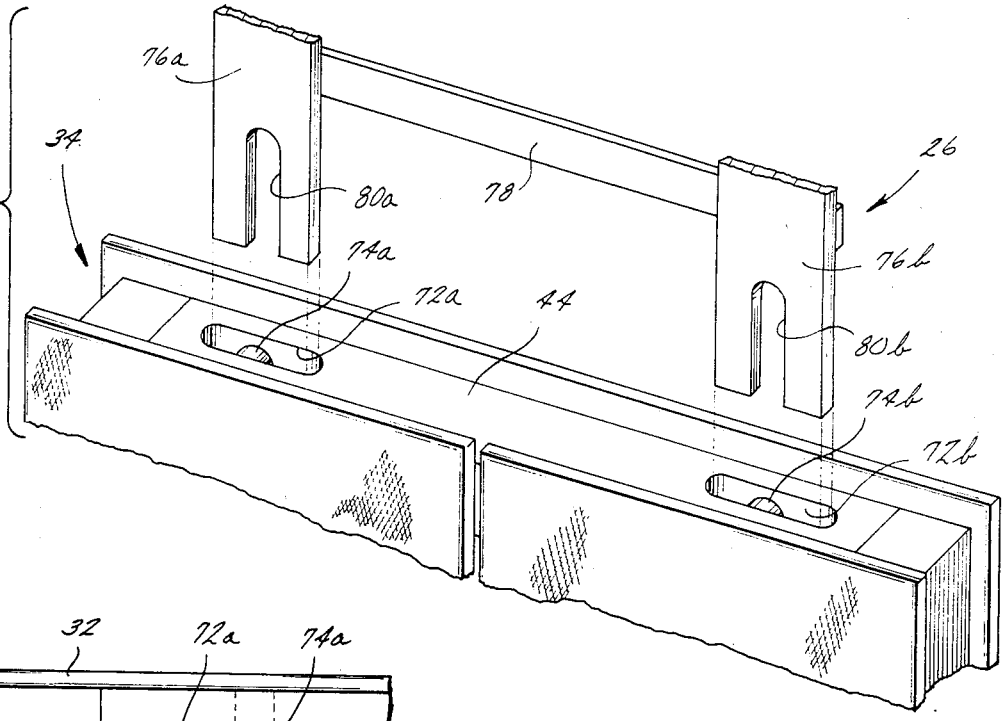
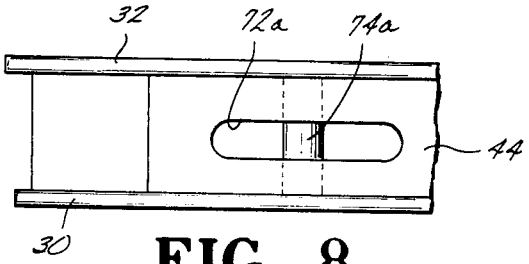
FIG. 8
FIG. 9
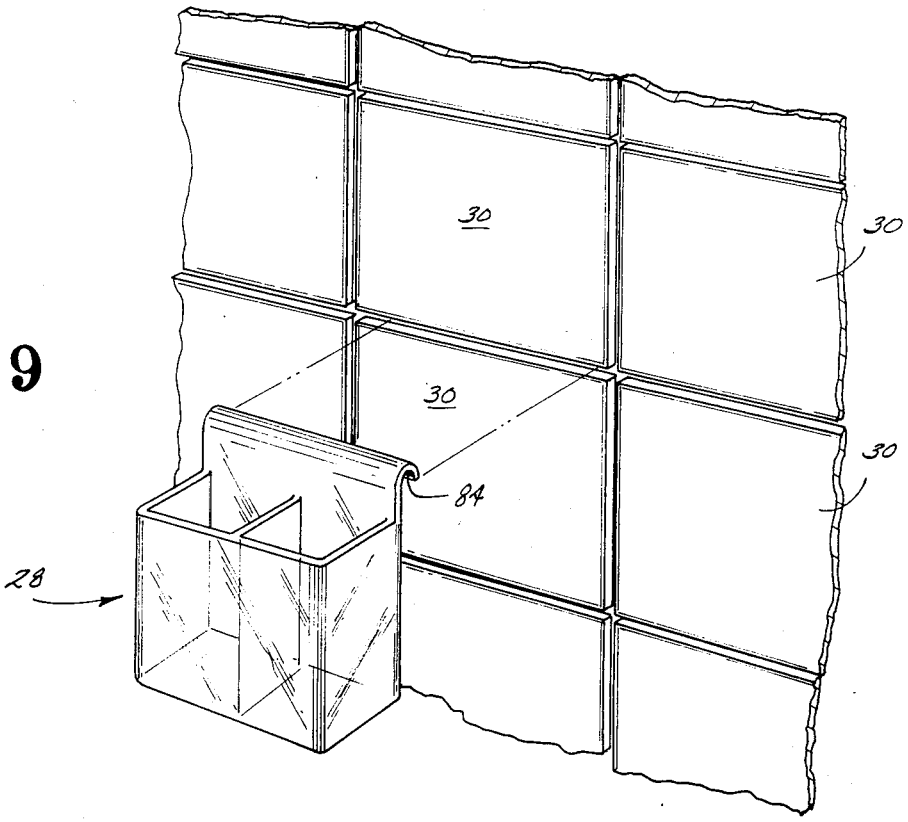

MODULAR PANEL CONSTRUCTION

BACKGROUND OF THE INVENTION

The present invention relates generally to a panel construction of the modular type which permits relatively easy assembly and disassembly of the individual components of the panel structure.

Trade shows have become more and more popular in recent years. A trade show enables a manufacturer to introduce new products into the marketplace. While there is no substitute for a quality product, the manner in which a product is presented to the prospective buyers is an important factor in determining the success of a given product. Consequently, a manufacturer will often spend considerable amounts of money in order to construct aesthetic displays at appropriate trade shows.

These displays, which are typically referred to as booths, are generally constructed of wood. Typically, a booth suitable for one trade show must often be altered or completely reconstructed for another trade show. This procedure usually requires the manufacturer to hire local tradesmen to perform the necessary assembly work. If a manufacturer appears at several trade shows during the course of the year, such routine becomes relatively expensive and time consuming.

Examples of prior art panel construction are disclosed in U.S. Pat. Nos. 3,327,440, 3,428,108 and 3,889,736.

SUMMARY OF THE INVENTION

The present invention relates to a modular panel construction which can be utilized to fabricate trade show type booths and can be readily assembled and disassembled for transportation or modifications.

The panel construction comprises a plurality of modular panel sections each having upper, side and lower marginal edges. Means are provided for interconnecting the adjacent side marginal edges of adjacent sections, and means are provided for coupling the lower marginal edges of each upper section with the upper marginal edge of an adjacent lower section. The plurality of individual sections cooperate to form a wall portion having an outer periphery defined by the arrangement of the individual sections.

The present invention also includes hinge means for pivotally interconnecting one wall portion of individual panel sections to adjacent wall portions of individual panel sections. The hinge means includes a pair of spaced apart brackets adapted to be fixedly secured to one of the wall portions along one marginal edge thereof and to be pivotally connected to an adjacent wall portion along one marginal edge thereof. The panel construction typically includes a plurality of longitudinally extending trim strips mounted on at least a portion of the outer peripheral marginal edges of the wall portions.

BRIEF DESCRIPTION OF THE DRAWINGS

The above, as well as other advantages of the present invention, will become readily apparent to one skilled in the art when reading the following detailed description in light of the accompanying drawings in which:

FIG. 7 is a perspective view illustrating the manner in which a bracket assembly can be connected to the upper end of a panel section for supporting a structure above the panel;

FIG. 8 is a top plan view of one of the bracket receiving slots of FIG. 7; and FIG. 9 is an exploded perspective view illustrating the manner in which a pamphlet holder can be attached to one of the panel sections.

DESCRIPTION OF THE PREFERRED EMBODIMENTS

Figure 1:
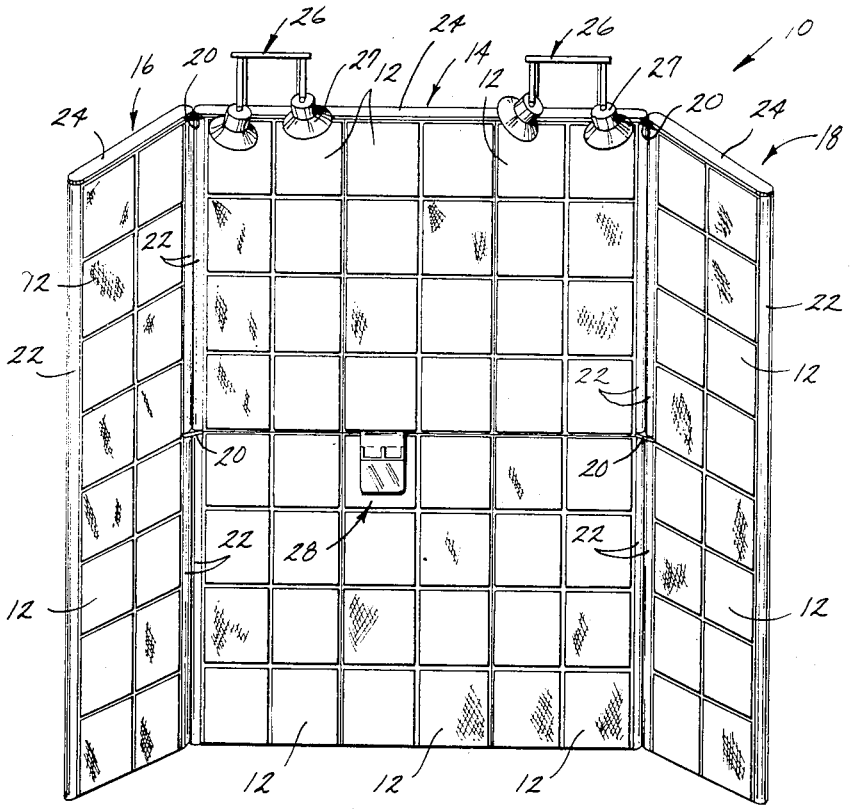
FIG. 1 is a perspective view of a modular panel construction display embodying the principles of the present invention.

Referring to FIG. 1, there is shown a modular panel construction 10 embodying the features of the present invention. While the panel construction can be utilized for a wide variety of applications, it has been found that such a construction is especially desirable for use in constructing display booths which are typically utilized at trade shows, for example. The panel construction provides an aesthetic display which can readily be assembled, disassembled and stored and then subsequently reconstructed at a different display site.

Figure 2:
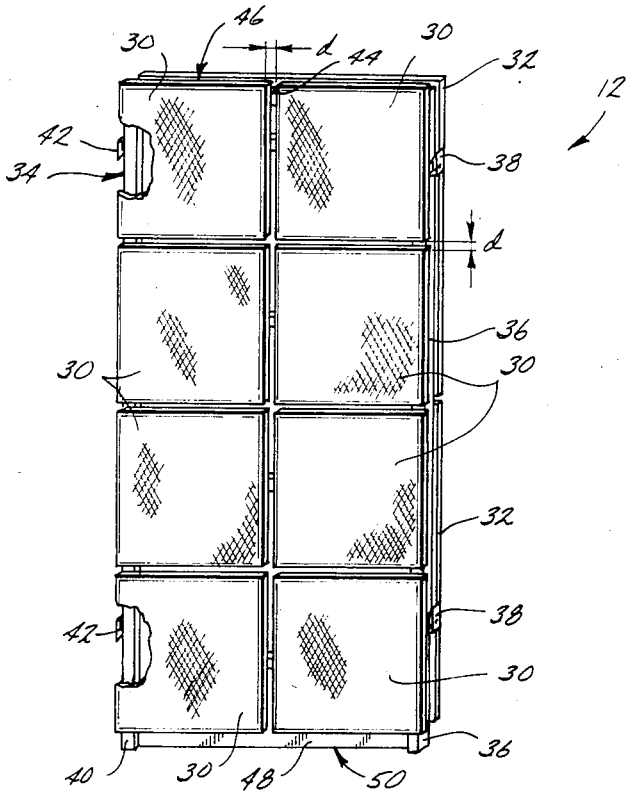
FIG. 2 is a perspective view of one of the individual panel sections which is utilized to construct the display of FIG. 1.

The display shown in FIG. 1 is comprised of a plurality of individual panel sections 12, one of which is illustrated in FIG. 2, which are coupled together and arranged in a predetermined manner to form a central wall portion 14 and two side wall portions 16 and 18. A group of six individual panel sections are utilized to form the central wall portion 14, while a stacked arrangement of two panel sections are utilized to form each of the two side wall portions 16 and 18. The manner in which the panels 12 are coupled together to form the wall portions of FIG. 1 will be discussed in more detail hereinafter.

In addition to the individual panel sections 12, the display 10 includes a plurality of other accessory components which cooperate with the panel sections 12 to produce the display arrangement shown in FIG. 1. Such components include hinge brackets 20 utilized to pivotally connect the side wall portions 16 and 18 to the central wall portion 14. Also included are vertical trim strips 22 positioned along the side edges of each of the wall portions 14, 16, and 18. The accessory components further include upper trim strips 24 positioned along top of the wall portions and upper mounting brackets 26 secured to the upper end of the central wall portion 14. The brackets 26 can be used to support articles such as lights 27 above the associated wall portion. Also shown in FIG. 1 is a brochure holder 28 which is readily adapted to be supported along an associated wall portion.

Referring to FIG. 2, there is shown a perspective view of one of the individual panel sections 12. While it will be appreciated that the outer periphery of each individual panel section can be of various shapes, it has been found that forming each panel section of a predetermined rectangular shape streamlines the design of the display. In FIG. 2, the panel section 12 includes a plurality of spaced apart tiles 30 on the front face thereof. The distance between adjacent marginal edges of the tiles 30 is shown in FIG. 2 as distance d. The front panel tiles 30 are maintained in spaced apart relationship from a back panel 32 by means of a frame structure 34. One side member 36 of the frame structure 34 is provided with a pair of spaced apart coupling brackets 38, while an opposite side frame member 40 is provided with a pair of spaced apart coupling brackets 42. As will be discussed, the coupling brackets 38 and 42 are utilized to interconnect the side marginal edge of the panel section 12 to an adjacent panel section or, alternatively, to one of the vertical trim strips 22.

Figure 3:
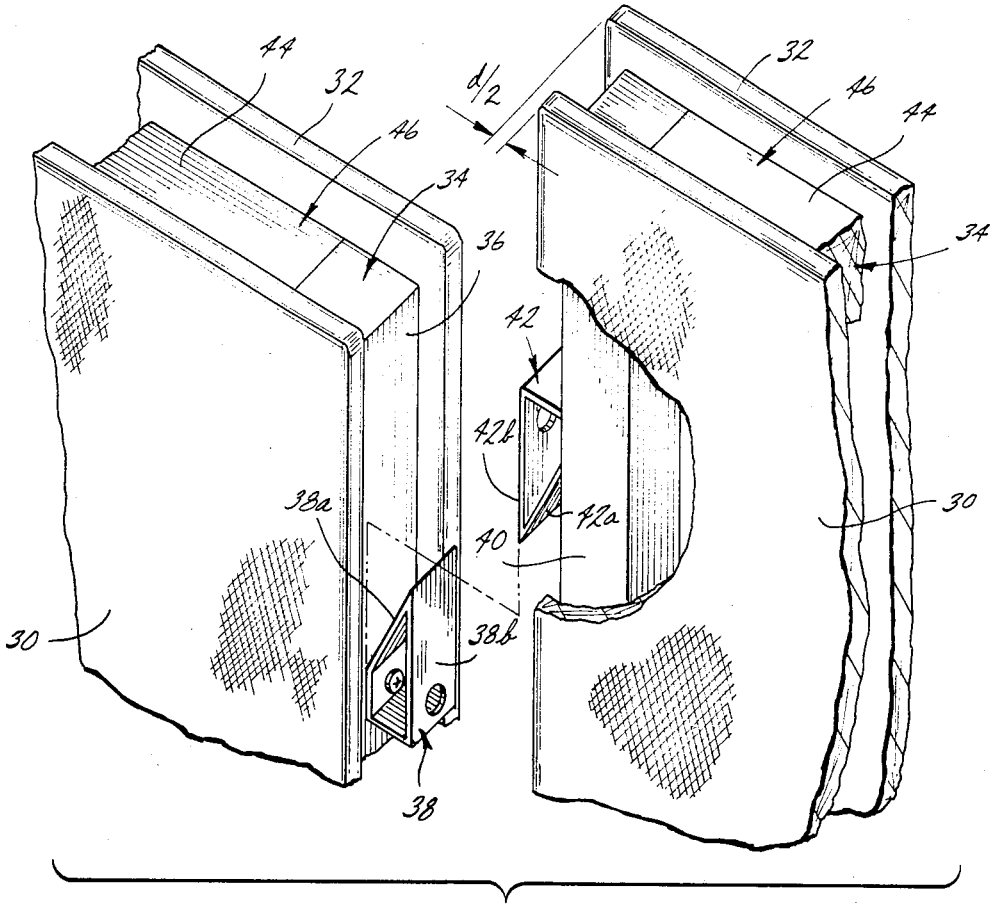
FIG. 3 is an exploded perspective view illustrating the manner in which the adjacent side marginal edges of adjacent panel sections are interconnected.

FIG. 3 illustrates the manner in which the side marginal edges of adjacent panel sections 12 are interconnected. The coupling brackets 38 are each provided with an upwardly facing inclined surface 38*a* and an outwardly facing vertical surface 38*b*, while the coupling brackets 42 are each provided with a downwardly facing inclined surface 42*a* and an outwardly facing vertical surface 42*b*. When the bracket 38 is coupled to the bracket 42, the inclined surfaces 38*a* and 42*a* engage each other while the vertical surface 38*a* of the bracket 38 abuts the side frame member 40 and the vertical surface 42*a* of the bracket 42 abuts the side frame member 36.

As shown in FIG. 3, the side marginal edges of the back panel 32 extend outwardly past the side marginal edges of the front tiles 30 by an amount which is represented as distance d/2. The brackets 38 and 42 are constructed such that, when the side marginal edges of two adjacent panel sections are interconnected, the adjacent side marginal edges of the front tiles 30 will be spaced apart by approximately the distance d, while the adjacent side marginal edges of the back panels 32 are adapted to abut against one another, thereby preventing light from passing between the edges of the adjacent back panels.

Figure 4:
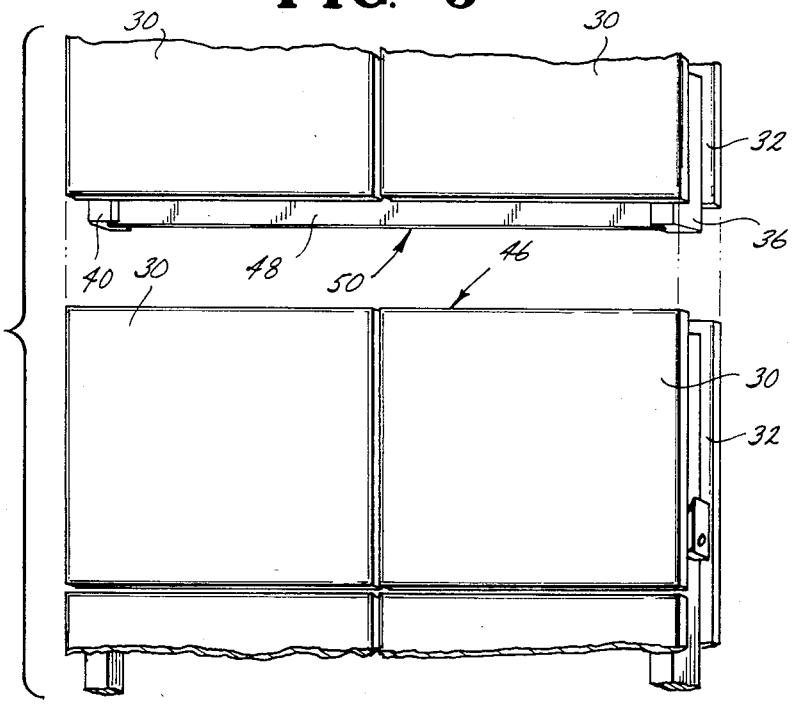
FIG. 4 is an exploded perspective view illustrating the manner in which the lower marginal edge of an upper panel section is coupled to the upper marginal edge of an adjacent lower panel section.

FIG. 4 illustrates the manner in which the upper marginal edge of a lower panel section is coupled to the lower marginal edge of an adjacent upper panel section. As shown in FIGS. 2 and 3, the frame structure 34 includes an upper frame member 44 which is spaced inwardly from the upper marginal edges of the front tiles 30 and the back panel 32 to form an elongate groove 46. As shown in FIGS. 2 and 4, the side members 36 and 40 of the frame structure extend downwardly past the lower marginal edges of the front tiles 30 and the back panel 32. A plate 48 extends between the lower ends of the side frame members 36 and 40 and cooperates with the side frame members to form a lower tongue portion 50.

The elongate groove 46 of the lower panel section is adapted to receive the lower tongue portion 50 of the upper panel section. The lower ends of the side frame members 36 and 40 are adapted to rest on the upper frame member 44 of the lower panel section. The side frame members 36 and 40 extend a predetermined amount below the lower edge of the lower tiles 30 such that, when the side frame members 36 and 40 are resting on the upper frame member of the lower adjacent panel section, the adjacent marginal edges of the front tiles 30 will be spaced apart by approximately the distance d. The plate 48 prevents any light from passing between the edges of the adjacent back panels 32.

Figure 5:
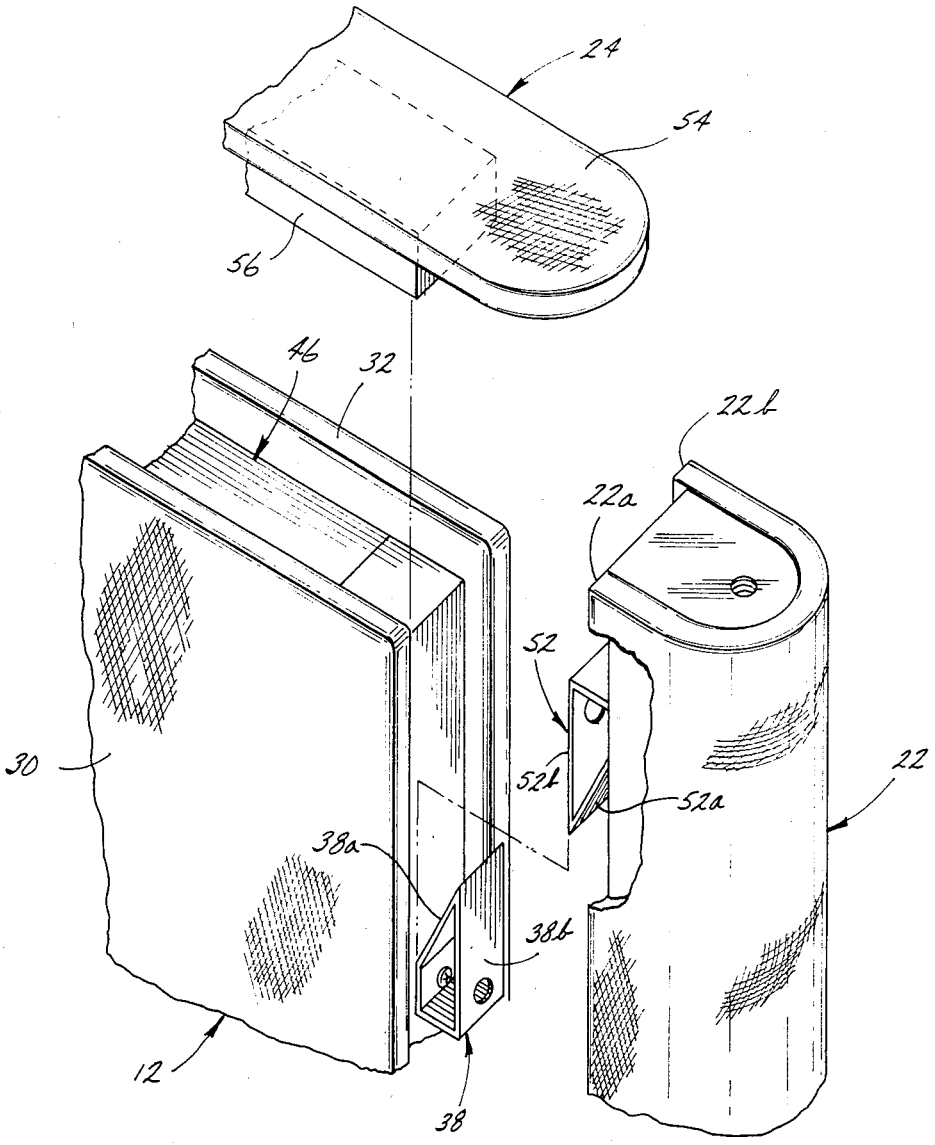
FIG. 5 is an exploded perspective view illustrating the manner in which an upper trim strip is coupled to the upper marginal edge of a panel section and a vertical trim strip is coupled to the side marginal edge of the panel section.

Referring to FIG. 5, there is shown the manner in which the vertical trim strips 22 and the upper trim strips 24 are connected to the outer periphery of the wall portions. The vertical trim strips 22 are connected to the side marginal edges of the panel section 12 in a manner similar to the connection of two adjacent panel sections. The trim strip 22 includes a pair of spaced apart coupling brackets 52 (only one of which is shown in FIG. 5) having a downwardly facing inclined surface 52*a* and a generally vertical surface 52*b*. The vertical trim strip 22 includes a front inner marginal edge portion 22*a* which, when the strip 22 is connected to the panel 12, is adapted to spaced apart from the side marginal edges of the front tiles 30 of the panel section 12 by the distance d. The vertical trim strip 22 includes a back inner marginal edge 22*b* which is adapted to abut the adjacent side marginal edge of the back panel 32 of the panel section 12, thereby blocking light from the rear of the wall portions.

The upper trim strip 24 includes a generally flat top 54 which extends outwardly past the edge of the panel section 12 and over the top of the vertical trim strip 22. An elongate frame member 56 is fastened to the lower side of the top 54 and is adapted to be inserted within the groove 46 formed along the top of the panel section 12.

Figure 6:
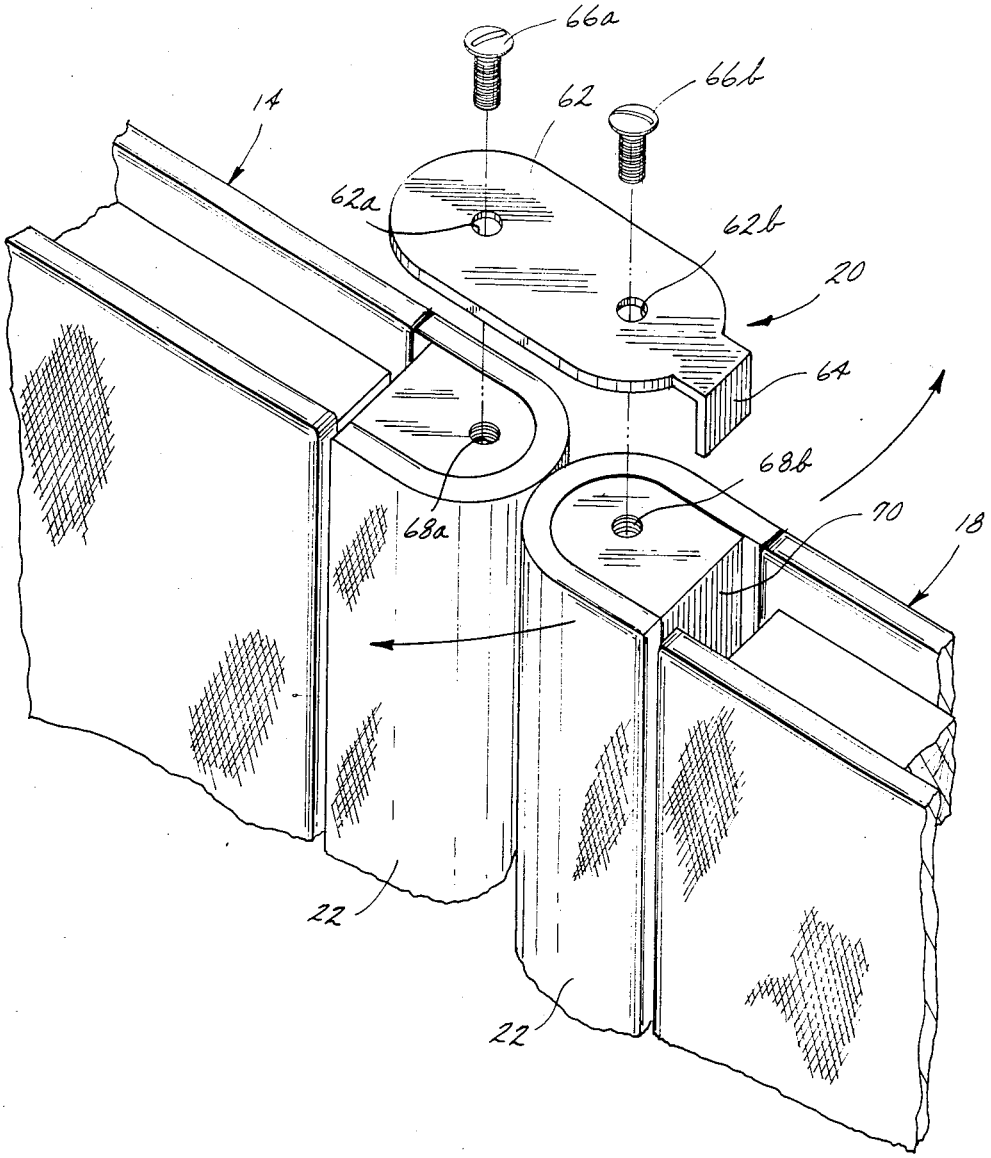
FIG. 6 is a perspective view illustrating the manner in which adjacent wall portions can be hingedly connected to one another.

FIG. 6 illustrates the manner in which the hinge brackets 20 of FIG. 1 are utilized to pivotally connect the side wall portion 18 to the central wall portion 14. As shown in FIG. 6, the adjacent side edges of the central wall portion 14 and the side wall portion 18 are provided with vertically extending trim strips 22. The hinge bracket 20 is adapted to be fastened to the adjacent vertical trim strips 22 to hingedly connect the two wall portions. The hinge bracket 20 includes a generally flat portion 62 having a downwardly extending tab 64 on one end thereof. The flat portion 62 is provided with a pair of spaced apart apertures 62*a* and 62*b*. A pair of threaded fasteners 66*a* and 66*b* are adapted to be inserted through the apertures 62*a* and 62*b* and into threaded apertures 68*a* and 68*b* formed in the upper end of the trim strips 22. The tab 64 is adapted to engage an inner flat surface 70 of one of the trim strips 22 and fixedly secure the bracket 20 relative to the side wall portion 18. The bracket 20 and the side wall 18 is adapted to pivot about the fastener 66*a*. A similar bracket arrangement can be utilized to fasten the intermediate and lower ends of the vertical trim strips.

Referring to FIGS. 7 and 8, there is shown an arrangement by which the bracket assembly 26 of FIG. 1 can be fastened to the upper end of an individual panel section. The bracket assembly 26 can be utilized for supporting a structure such as lights, for example, above the associated panel. As shown in FIGS. 7 and 8, the upper member 44 of the frame structure 34 is provided with a pair of spaced apart elongate slots 72*a* and 72*b* having transverse steel support pins 74*a* and 74*b* respectively which extends through the frame member 44 and into the central portion of the respective slot. The bracket assembly 70 includes a pair of support members 76*a* and 76*b* which are maintained in a spaced apart relationship by cross member 78. The lower ends of the support members 76*a* and 76*b* are provided with downwardly facing slots 80*a* and 80*b* which are adapted to receive the associated support pins when the lower ends of the support members 76*a* and 76*b* are inserted into the elongate slots 72*a* and 72*b* respectively.

FIG. 9 illustrates the brochure or pamphlet holder 28 of FIG. 1 which can readily be supported along any of the wall portions shown in FIG. 1. The brochure holder 28 includes an upper lip portion 84 which can be positioned across the upper edge of any one of the tiles 30. In addition to a brochure or pamphlet holder, the tiles 30 can be utilized to support other types of structures, such as ashtrays, for example, by using a similar support arrangement.

In accordance with the provisions of the patent statutes, the principles and mode of operation of the present invention have been explained in what is considered to represent its preferred embodiment. It should, however, be understood that the invention may be practiced otherwise than as specifically illustrated and described without departing from its spirit or scope.

What is claimed is:

1. A modular panel construction comprising:

a plurality of rectangular modular panel sections each having upper, side, and lower marginal edges, each of said panel sections provided with at least two individual, substantially identically shaped rectangular panels securely and rigidly attached thereto and having parallel adjacent marginal edges spaced apart from one another by a predetermined distance defining a significant gap therebetween;

said plurality of panel sections including a first panel section having a side marginal edge connected to a side marginal edge of an adjacent second panel section, means for releasably interconnecting the adjacent side marginal edges of said first and second sections, said interconnecting means including means for maintaining the side marginal edge of the rectangular panels of said first panel section spaced from the side marginal edge of the adjacent rectangular panels of said adjacent second panel section by said predetermined distance; and said plurality of panel sections further including a third panel section having a lower marginal edge coupled to an upper marginal edge of said first panel section, means for releasably coupling the lower marginal edge of said third panel section with the upper marginal edge of said first panel section, said coupling means including means for maintaining the lower marginal edge of a rectangular panel of said third section spaced from the upper marginal edge of an adjacent rectangular panel of said lower first section by said predetermined distance, said plurality of sections cooperating to form a grid-like wall member defined by a plurality of spaced apart individual rectangular panels.

* * * * *